US005335918A

United States Patent [19]

Rupnik et al.

[11] Patent Number: 5,335,918

[45] Date of Patent: Aug. 9, 1994

[54] GOLF CLUB SWING TRAINING DEVICE

[75] Inventors: Thomas J. Rupnik, Lodi; Ron Kite, Nevada City, both of Calif.

[73] Assignee: Ace Trainer, Inc., Grass Valley, Calif.

[21] Appl. No.: 12,449

[22] Filed: Feb. 2, 1993

[30] Foreign Application Priority Data

May 29, 1992 [NZ] New Zealand ..... 242965

[51] Int. Cl.[5] ..... A63B 69/36

[52] U.S. Cl. ..... 273/186.2; 273/194 R; 482/109; 482/111

[58] Field of Search ..... 273/186.1, 186.2, 186.3, 273/186.4, 193 R, 194 R, 194 A, 194 B, 193 A; 482/109, 111

[56] References Cited

U.S. PATENT DOCUMENTS

| | | | |
|---|---|---|---|
| 4,576,378 | 3/1986 | Bachus | 273/194 R X |
| 4,973,049 | 11/1990 | Ciolino | 482/111 |
| 5,100,148 | 3/1992 | Smith | 482/109 X |
| 5,184,825 | 2/1993 | Ruth | 273/186.2 |

*Primary Examiner*—George J. Marlo

*Attorney, Agent, or Firm*—Brady, O'Boyle & Gates

[57] ABSTRACT

A training airfoil attachment for a golf club wherein a member curved in cross-section and having a convex upper surface and a concave lower surface, and substantially straight leading and trailing edges, is attached to the shaft of the golf club to promote the correct swing due to the airflow over the airfoil imparting a lift on the convex side of the airfoil.

11 Claims, 2 Drawing Sheets

FIG. 1
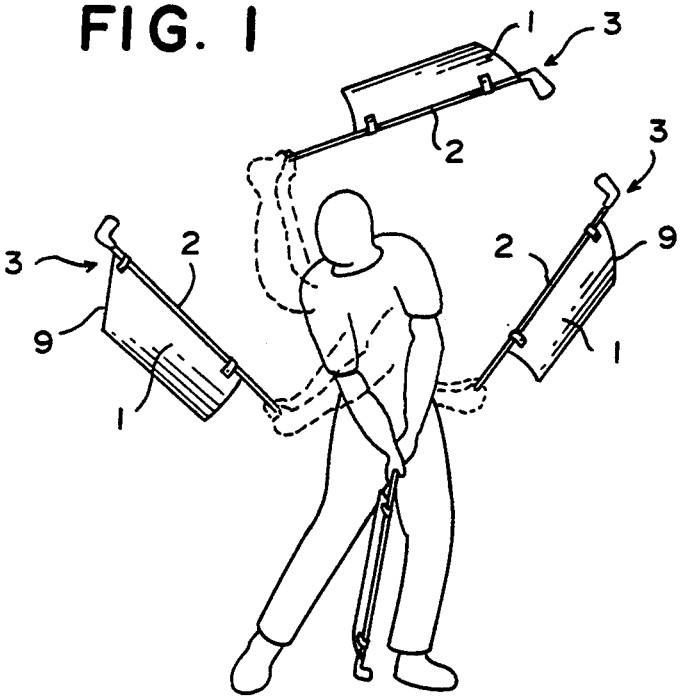
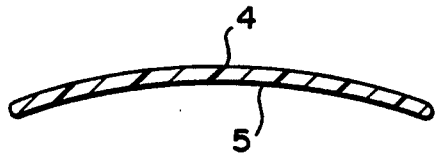
FIG. 2
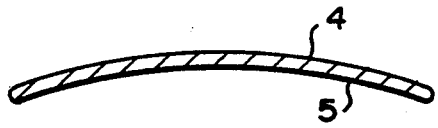
FIG. 3
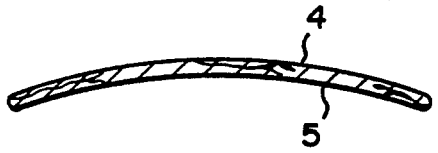
FIG. 4
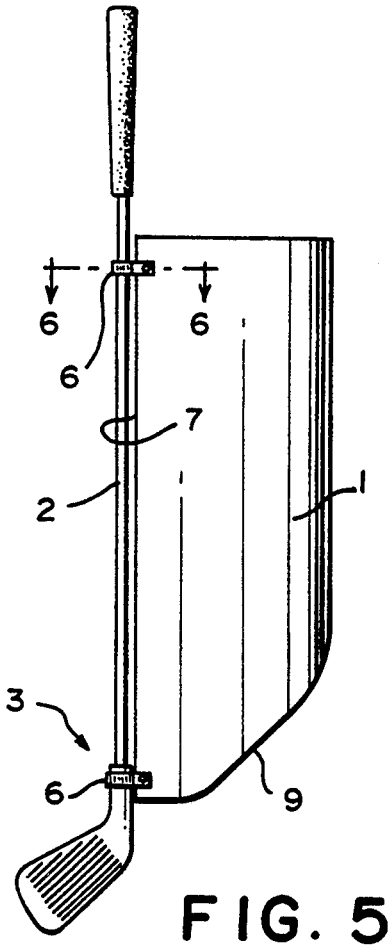
FIG. 5
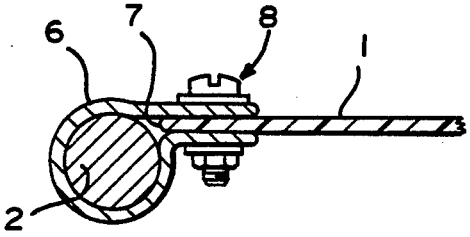
FIG. 6

GOLF CLUB SWING TRAINING DEVICE

BACKGROUND OF THE INVENTION

The most prevalent fault in golfers is the slice swing wherein the golf club head connects with the ball in a manner that the toe of the club head is behind the base of the head so that the ball is not hit squarely but by the face of the golf club in a plane angled to the right, thus causing the ball to spin and veer off to the right. There are several aspects to a good golf swing. The release is that aspect of the swing which relates to the hitting area and part of the release motion is the release crossover where both forearms rotate causing the right palm to be almost facing the ground at a point halfway into the through swing or follow through. It is preferable to allow the arms to swing extended until reaching the reset position which is approximately waist high on the through swing and, at that point, the hands start to reset or rehinge to the follow through position. This reset does not occur in the slice swing because the left arm collapses instead of rotating and the right hand goes through palm up instead of palm down. A high follow through is desirable and keeps the swing on plane longer, carrying the hands to a high finish.

In an attempt to correct the slice swing, it has been proposed to attach a small flat airfoil to the shaft of a golf club, as disclosed in U.S. Pat. No. 4,576,378. While this training device has been somewhat satisfactory for its intended purpose, the training attachment of the present invention is an improvement thereon.

SUMMARY OF THE INVENTION

The training airfoil attachment of the present invention comprises, essentially, a member curved in cross-section and having a convex upper surface and a concave lower surface and substantially straight leading and trailing edges. The trailing edge of the airfoil is connected to the shaft of a golf club thereby promoting the correct swing due to the airflow over the airfoil imparting a lift on the convex side of the airfoil in the same way as an aircraft wing is lifted by the air flowing from the leading edge over the longer or convex edge. The lift imparted to the airfoil is further enhanced when the golf club and associated attachment is swung into the wind. This lift effect is not provided by the flat plate airfoil disclosed in U.S. Pat. No. 4,576,378 which provides more wind resistance than lift effect.

In the instant invention, resistance is felt only if the club is swung incorrectly; in which case, as the club is swung down, the golfer will hear a swooshing sound before the hitting area is reached, indicating that the face of the club is closed due to an incorrect grip or hand position, or the golfer has started his release too early. The sound caused by the airfoil thereby alerts the golfer to an incorrect swing.

The airfoil of the present invention is dimensioned to be larger and therefore more visual than the airfoil in the aforementioned patent to thereby provide a visual aid so that the golfer viewing his or her reflection in a window or mirror can visually check the appearance of the airfoil in relation to the club in a good swing.

The training airfoil attachment of the present invention can be fabricated from various materials such as wood or plastic, either injection molded to shape or formed from sheet, or various metals and alloys such as aluminum or other easily workable or castable metal or composite materials.

The airfoil can be integrally formed with the shaft of the golf club or can be detachably connected to the shaft by clamps or quick-release fasteners.

BRIEF DESCRIPTION OF THE DRAWINGS

FIG. 1 is a perspective view of the training airfoil attachment of the present invention connected to the shaft of a golf club gripped by a golfer and shown in various positions along a golf swing;

FIG. 2 is a cross-sectional view of the airfoil of the present invention fabricated from plastic;

FIG. 3 is a cross-sectional view of the airfoil fabricated from metal;

FIG. 4 is a cross-sectional view of the airfoil fabricated from wood;

FIG. 5 is a side elevational view of the airfoil of the present invention secured to the shaft of a golf club by a pair of clamps and extending substantially the length of the shaft;

FIG. 6 is a view taken along line 6—6 of FIG. 5;

DESCRIPTION OF THE PREFERRED EMBODIMENTS

Figure 7:
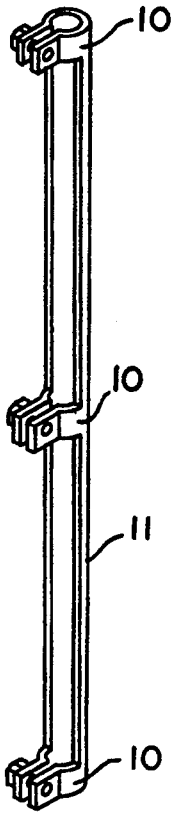
FIG. 7 is a perspective view of another embodiment of a clamp for securing the airfoil of the present invention to the shaft of a golf club.

Referring to the drawings and more particularly to FIGS. 1 and 5, the training airfoil attachment 1 of the present invention is connected to the shaft 2 of a conventional golf club 3 and extends substantially along the length of the club shaft 2.

As will be seen in FIGS. 2, 3 and 4, the airfoil 1 is formed as a thin curved member having a convex upper surface 4 and a concave lower surface 5, and can be fabricated from plastic, metal or wood, as shown. As will be seen in FIG. 5, the airfoil 1 is secured to the golf club shaft 2 by a pair of clamps 6 axially spaced on the shaft 2 and secured to the trailing edge portion 7 of the airfoil 1 by a nut and bolt assembly 8; and in order that the bottom edge of the airfoil 1 will clear the ground during the golfer's swing, it is cut-away as at 9.

While FIG. 5 discloses a pair of separate clamps 6 for securing the airfoil 1 to the golf club shaft 2, FIG. 7 shows another embodiment for securing the airfoil to the golf shaft wherein three clevis-type clamps 10, of the type shown in FIGS. 5 and 6, are integral with a spine member 11 which would extend along the golf club shaft.

Figure 8:
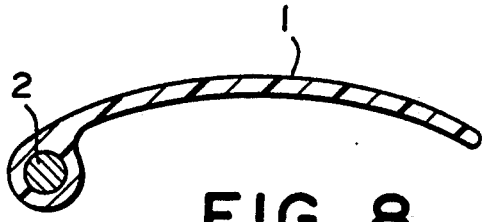
FIG. 8 is a cross-sectional view of the airfoil of the present invention formed integral with the shaft of a golf club.

FIG. 8 illustrates another embodiment of securing the airfoil 1 to the golf club shaft 2 wherein the airfoil is formed integral with the shaft.

Figure 9:
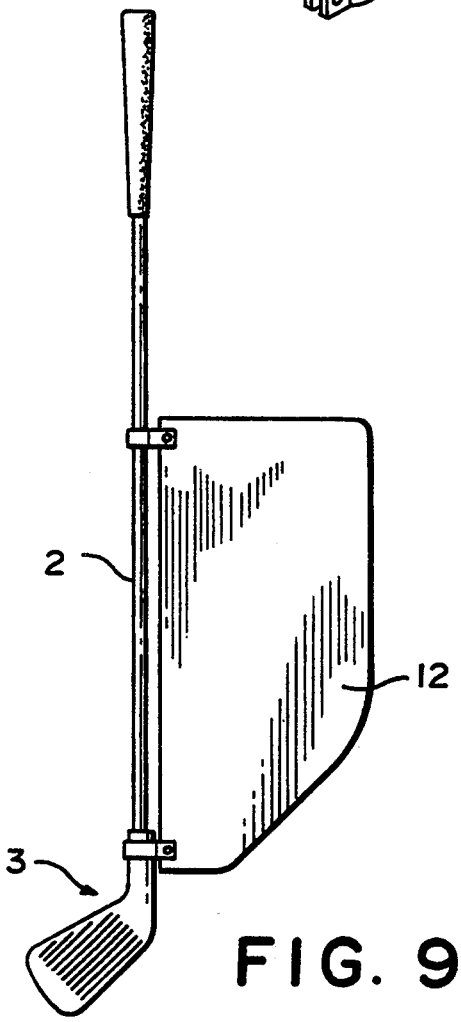
FIG. 9 is a side elevational view of the airfoil of the present invention secured to the shaft of a golf club and having a linear dimension substantially less than the airfoil shown in FIG. 5.

While the airfoil 1 as shown in FIG. 5 is dimensioned to extend substantially along the entire length of the golf club shaft 2, FIG. 9 shows an airfoil 12 having a length substantially less than the length of the golf club shaft 2, whereby the position of the airfoil 12 can be adjusted along the length of the golf club shaft 2 so that more drag would be imparted to the golf club 3 when the airfoil 12 is positioned at the lower end of the shaft 2, and less drag when the airfoil 12 is positioned toward the upper portion of the shaft.

Figure 10:
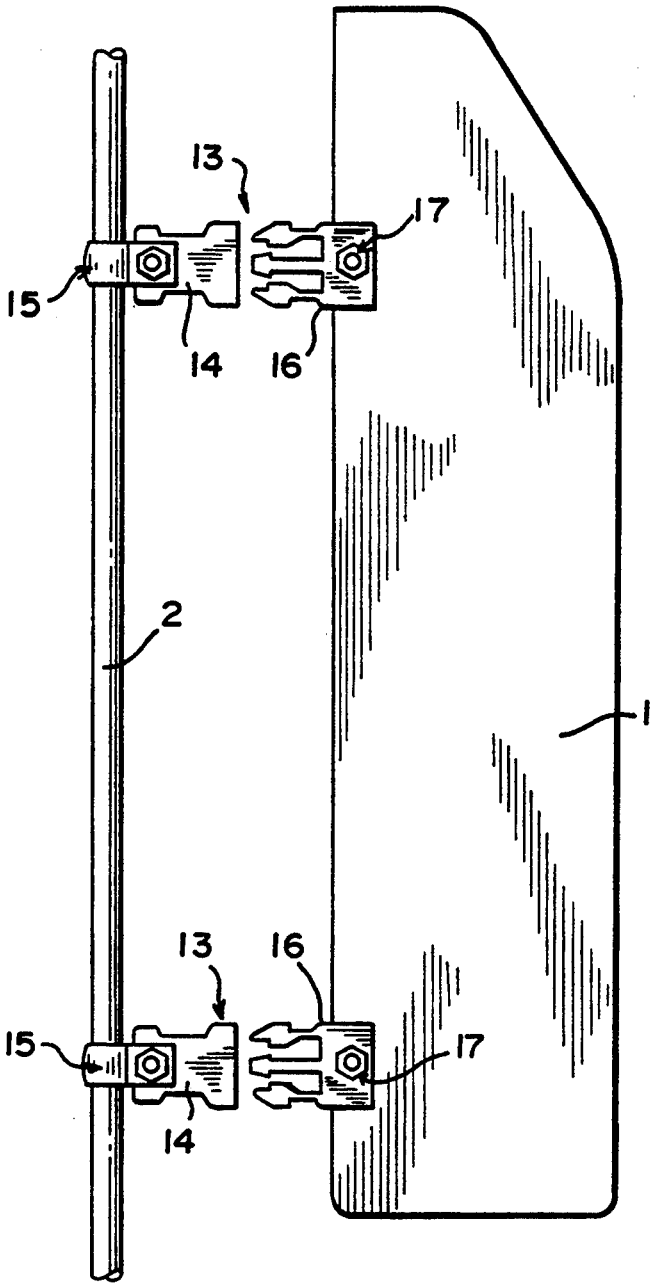
FIG. 10 is an enlarged, fragmentary, side elevational view of an airfoil and shaft of a golf club having cooperating components of a side squeeze snap fastener for detachably connecting the airfoil to the shaft.

FIG. 10 illustrates still another manner of securing the airfoil 1 to the golf club shaft 2 by conventional side squeeze snap fasteners 13 wherein one component 14 of each fastener is secured to the club shaft as at 15 and the other component 16 of the fastener is secured to the airfoil as at 17.

The airfoil 1 is dimensioned to have a length of 22 inches by 8 inches by one-sixteenth of an inch in thickness and a weight of approximately 7 ounces, while airfoil 12 is dimensioned to have a length approximately 15 inches, and while the airfoil is shown connected to the shaft of an iron, it can also be connected to the shaft of a wood.

From the above description, it will be appreciated by those skilled in the art that the training airfoil golf club attachment of the present invention is constructed and arranged to improve the swing of a golfer and helps to eliminate the slice which is a recurring problem with many golfers. A further benefit of the attachment is that it increases hand speed and improves release in the hitting area, plus it encourages the rotation of both fore arms causing the right palm to be almost facing the ground at a point halfway into the through swing or follow through, thereby promoting a high follow through. By attaching the airfoil 1 to the golf club 3 as described hereinabove, as the club approaches the ball, the airflow over the airfoil causes the club head to close to the left thereby promoting the hook swing. This gives the golfer "the feel" of a good swing and as the golfer becomes familiar with the differences between a good and a bad swing, as is forced upon the golfer by the airfoil attachment, the golfer can ultimately detach the airfoil and continue with the same style of swing to achieve a faster club head speed, greater distance and more accuracy.

It is to be understood that the forms of the invention herewith shown and described are to be taken as preferred examples of the same, and that various changes in the shape, size and arrangement of parts may be resorted to, without departing from the spirit of the invention or scope of the subjoined claims.

We claim:

1. A golf club including an airfoil attachment wherein said attachment comprises a member curved in cross-section and having a convex upper surface, a concave lower surface, and substantially straight leading and trailing edges, the trailing edge of said airfoil being connected to the shaft of said golf club and extending generally parallel thereto, to thereby promote a correct swing due to the airflow over the airfoil imparting a lift on the convex side of the airfoil.

2. A training airfoil according to claim 1, wherein the airfoil is connected to the shaft of the golf club by a pair of axially spaced clamps extending between the airfoil and the golf club shaft.

3. A training airfoil according to claim 1, wherein the airfoil is connected to the shaft of the golf club by a plurality of clamps integral with a spine member, said spine member extending along the length of said golf shaft, said clamps extending between said spine member and said airfoil.

4. A training airfoil according to claim 1, wherein the airfoil is formed integral with the golf shaft.

5. A training airfoil according to claim 1, wherein the airfoil is connected to the shaft of the golf club by a plurality of side squeeze snap fasteners.

6. A training airfoil according to claim 1, wherein the airfoil is dimensioned to extend substantially along the entire length of the golf club shaft.

7. A training airfoil according to claim 1, wherein the lower edge of the airfoil is contoured such that the bottom edge of the airfoil will clear the ground during the golfer's swing.

8. A training airfoil according to claim 1, wherein the airfoil is dimensioned to have a length substantially less than the length of the golf club shaft, whereby the position of the airfoil is adjustable along the length of the golf club shaft, to thereby vary the drag imparted to the golf club during the golfer's swing.

9. A training airfoil according to claim 1, wherein the airfoil is fabricated from plastic.

10. A training airfoil according to claim 1, wherein the airfoil is fabricated from metal.

11. A training airfoil according to claim 1, wherein the airfoil is fabricated from wood.

* * * * *